US011313626B2

(12) United States Patent
Liu et al.

(10) Patent No.: US 11,313,626 B2
(45) Date of Patent: Apr. 26, 2022

(54) HEAT PIPE

(71) Applicant: VAST GLORY ELECTRONICS & HARDWARE & PLASTIC(HUI ZHOU) LTD., Hui Zhou (CN)

(72) Inventors: Lei Lei Liu, Hui Zhou (CN); Xue Mei Wang, Hui Zhou (CN)

(73) Assignee: VAST GLORY ELECTRONICS & HARDWARE & PLASTIC(HUI ZHOU) LTD., Hui Zhou (CN)

( * ) Notice: Subject to any disclaimer, the term of this patent is extended or adjusted under 35 U.S.C. 154(b) by 52 days.

(21) Appl. No.: 16/985,715

(22) Filed: Aug. 5, 2020

(65) Prior Publication Data

US 2021/0293486 A1 Sep. 23, 2021

(30) Foreign Application Priority Data

Mar. 19, 2020 (CN) ..... 202010196720.5

(51) Int. Cl.
*F28D 15/04* (2006.01)

(52) U.S. Cl.
CPC ..... *F28D 15/04* (2013.01)

(58) Field of Classification Search
CPC ... F28D 15/04; F28D 15/046; H05K 7/20336; H05K 7/2029; H01L 23/427
USPC ..... 165/104.26
See application file for complete search history.

(56) References Cited

U.S. PATENT DOCUMENTS 3,754,594 A * 8/1973 Ferrell ..... F28D 15/046 165/272
4,674,565 A * 6/1987 Beam ..... F28D 15/046 165/104.26
8,590,601 B2 * 11/2013 Lee ..... F28D 15/046 165/104.26
8,615,878 B2 * 12/2013 Chou ..... F28D 15/046 29/890.032
2006/0131002 A1 * 6/2006 Mochizuki ..... F28D 15/046 165/104.26
2007/0193723 A1 * 8/2007 Hou ..... F28D 15/046 165/104.26
2009/0071633 A1 * 3/2009 He ..... F28D 15/0233 165/104.26
2011/0108243 A1 * 5/2011 Hou ..... F28D 15/046 165/104.26
2013/0092354 A1 * 4/2013 Semenov ..... F28D 15/04 165/104.26

FOREIGN PATENT DOCUMENTS

JP 2017072340 A * 4/2017
SU 800577 A1 * 1/1981

* cited by examiner

*Primary Examiner* — Tho V Duong
(74) *Attorney, Agent, or Firm* — Maschoff Brennan

(57) ABSTRACT

This disclosure relates to a heat pipe includes a tubular body and a capillary structure. The tubular body has an inner surface. The inner surface forms a sealed chamber. The capillary structure is located in the sealed chamber and arranged on the inner surface. The tubular body includes a condensation section and an evaporation section connected to each other. The capillary structure includes a cold section and a heat section connected to each other. The cold section is disposed on the condensation section, and the heat section is disposed on the evaporation section. A wall thickness of the cold section is greater than a wall thickness of the heat section.

12 Claims, 3 Drawing Sheets

HEAT PIPE

CROSS-REFERENCE TO RELATED APPLICATIONS

This non-provisional application claims priority under 35 U.S.C. § 119(a) on Patent Application No(s). 202010196720.5 filed in China, P.R.C. on Mar. 19, 2020, the entire contents of which are hereby incorporated by reference.

TECHNICAL FIELD

The present disclosure relates to a heat dissipation device, more particularly to a heat pipe.

BACKGROUND

A heat pipe is a hollow cylinder or tubular section of metal and is designed to evenly distribute heat. The heat pipe was first used for aerospace technology years ago; now it has been widely used in various heat exchangers, coolers, and the like.

The heat pipe has a sealed internal chamber for accommodating a working fluid or coolant. The vaporization and condensation of the working fluid can form a closed cooling circulation in the sealed internal chamber so that the heat pipe features rapid and even heat distribution to achieve the purpose of heat transfer. In detail, partial evaporation of the working fluid takes place at the evaporation section so as to produce high pressure to drive the gaseous working fluid to flow towards the condensation section, the gaseous working fluid is cooled and condensed into liquid at the condensation section, and the heat pipe employs a capillary structure to promote the flow of the condensed working fluid back to the evaporation section.

However, in some applications that the condensation section is placed lower than the evaporation section may cause the capillary action to work against gravity, such that the capillary structure might not effectively bring the working fluid back to the evaporation section. This issue usually causes the evaporation section to be heated in a dry condition.

SUMMARY

The present disclosure provides a heat pipe capable of ensuring a sufficient capillary action force and heat transfer while working against gravity.

According to one aspect of the present disclosure, a heat pipe includes a tubular body and a capillary structure. The tubular body has an inner surface. The inner surface forms a sealed chamber. The capillary structure is located in the sealed chamber and arranged on the inner surface. The tubular body includes a condensation section and an evaporation section connected to each other. The capillary structure includes a cold section and a heat section connected to each other. The cold section is disposed on the condensation section, and the heat section is disposed on the evaporation section. A wall thickness of the cold section is greater than a wall thickness of the heat section.

According to the heat pipe discussed above, the cold section has a thicker wall thickness than the heat section of the capillary structure, such that, while the evaporation section is placed higher than the condensation section, the condensation section of the heat pipe still has a sufficient capillary action force to work against gravity, and the evaporation section of the heat pipe still has a sufficient evaporation rate, thereby forming the cooling circulation. And, the capability of transmitting liquid of the cold section to the other one is stronger than that of the heat section, and the capability of evaporating liquid of the heat section to the sealed chamber is stronger than that of the cold section. As such, the heat pipe can offer a sufficient capillary action force and effective heat transfer to ensure its functionality.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
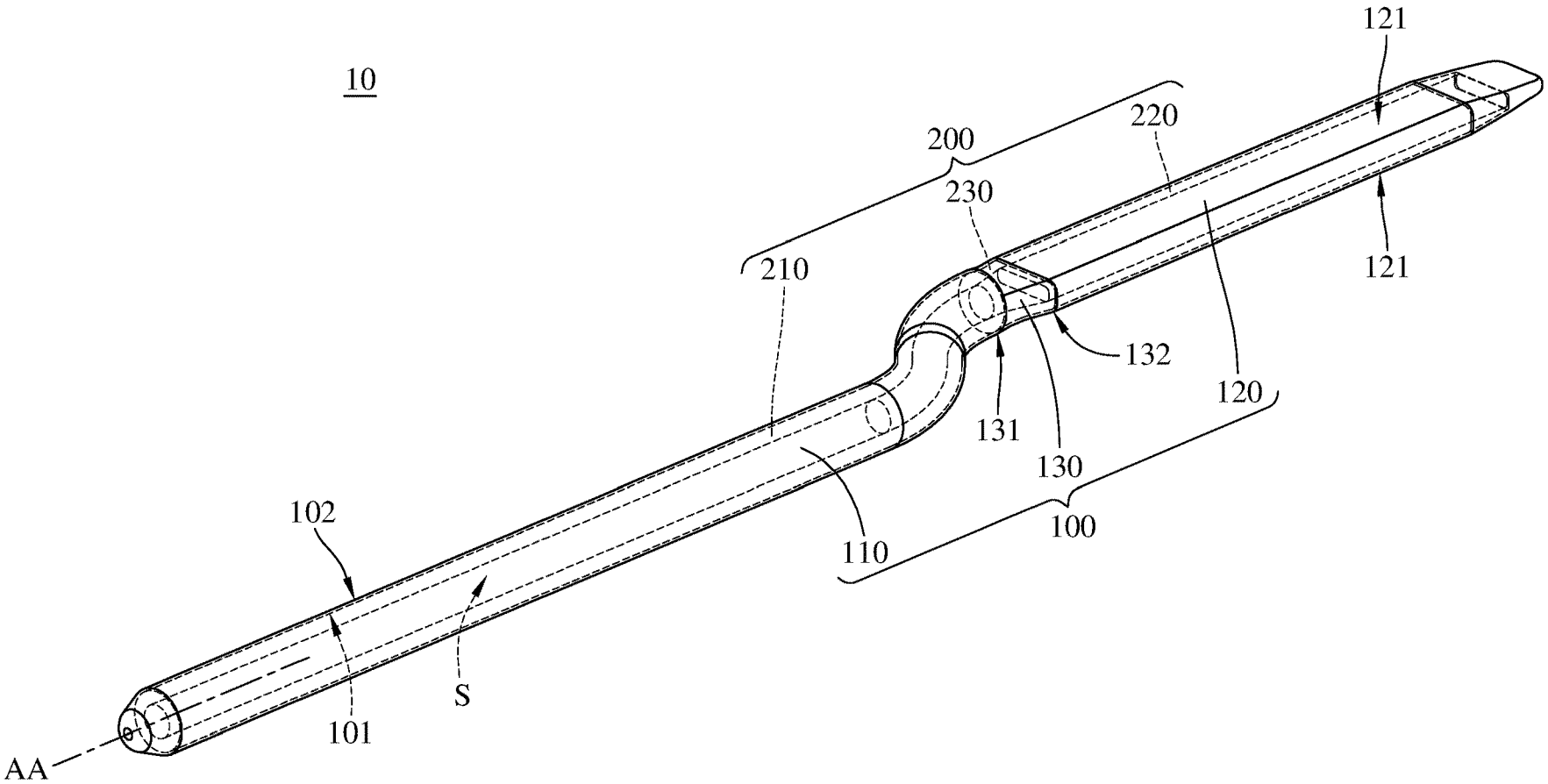
FIG. 1 is a perspective view of a heat pipe according to a first embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
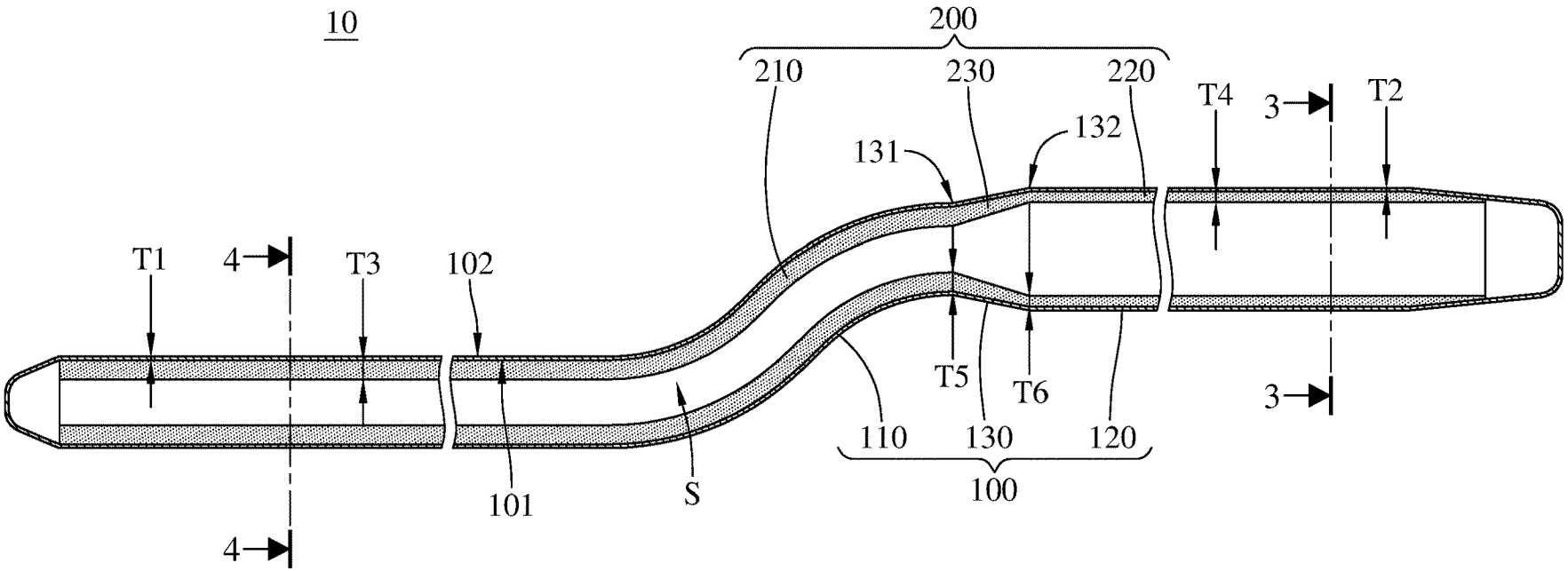
FIG. 2 is a cross-sectional view of the heat pipe in FIG. 1.
Figure 4:
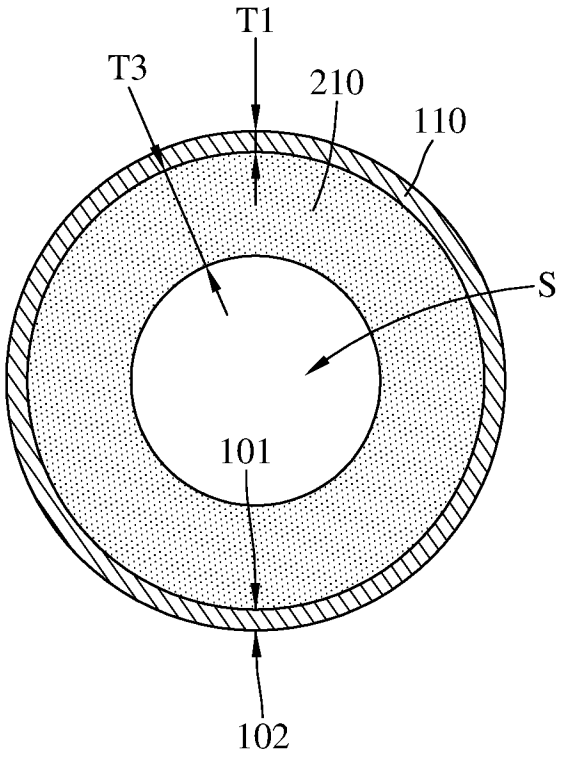
FIG. 4 is a cross-sectional view of the heat pipe taken along line 4-4 in FIG. 2.
Figure 3:
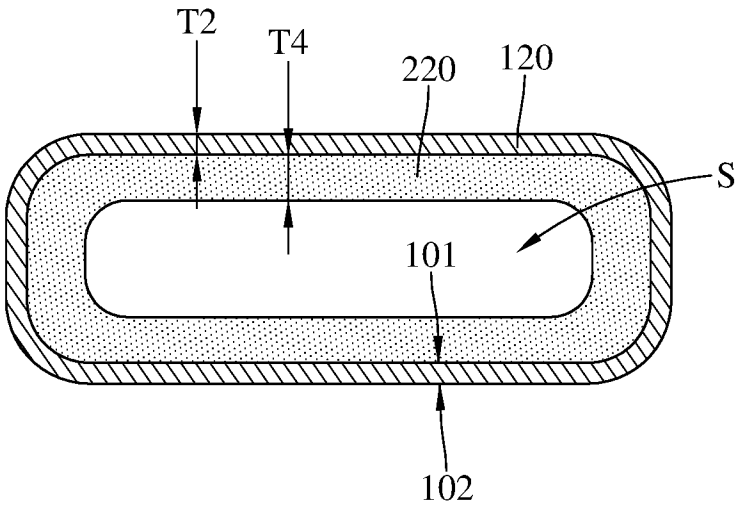
FIG. 3 is a cross-sectional view of the heat pipe taken along line 3-3 in FIG. 2.

Please refer to FIG. 1 to FIG. 4, where FIG. 1 is a perspective view of a heat pipe according to a first embodiment of the present disclosure, FIG. 2 is a cross-sectional view of the heat pipe in FIG. 1, FIG. 3 is a cross-sectional view of the heat pipe taken along line 3-3 in FIG. 2, and FIG. 4 is a cross-sectional view of the heat pipe taken along line 4-4 in FIG. 2.

This embodiment provides a heat pipe 10. The heat pipe 10 includes a tubular body 100 and a capillary structure 200. The tubular body 100 has an inner surface 101 and an outer surface 102. The inner surface 101 forms a sealed chamber S. The outer surface 102 faces away from the inner surface 101 and is exposed outside. In this embodiment, the inner surface 101 is, for example but not limited to, a smooth surface without grooves or recesses provided thereon.

The tubular body 100 includes a condensation section 110, an evaporation section 120, and a connection section 130. In this embodiment, the condensation section 110 of the tubular body 100 is in a cylindrical shape. The evaporation section 120 of the tubular body 100 is in a relatively flat shape compared to the condensation section 110. The evaporation section 120 of the tubular body 100 has two thermal contact surfaces 121 that are opposite to and parallel to each other. The thermal contact surfaces 121 are configured to be in thermal contact with a heat source (not shown).

In this embodiment, as shown, a wall thickness T1 of the condensation section 110 of the tubular body 100 is equal to a wall thickness T2 of the evaporation section 120 of the tubular body 100, but the present disclosure is not limited thereto. In some other embodiments, the condensation section of the tubular body and the evaporation section of the tubular body may have different wall thicknesses.

In this embodiment, the wall thickness T1 of the condensation section 110 is uniform from one end to the other, and the wall thickness T2 of the evaporation section 120 is also uniform from one end to the other; however, the present disclosure is not limited thereto. In some other embodiments, the tubular body may have a condensation section of non-uniform wall thickness; in another embodiment, the tubular body may have an evaporation section of non-uniform wall thickness.

The connection section 130 of the tubular body 100 has a first end 131 and the second end 132 that are opposite to each other and are respectively connected to the condensation section 110 and the evaporation section 120. As shown, the first end 131 of the connection section 130 is in a cylindrical shape and the second end 132 of the connection section 130 is in a relatively flat shape.

In this embodiment, the connection section 130 of the tubular body 100 is configured to connect the condensation section 110 and the evaporation section 120 that are in different shape, but the present disclosure is not limited thereto. In some other embodiments where the condensation section and the evaporation section have the same cross-sectional shape, the tubular body may omit the aforementioned connection section.

The capillary structure 200 is located in the sealed chamber S and is arranged on the inner surface 101. In detail, the capillary structure 200 includes a cold section 210, a heat section 220, and a link section 230. The cold section 210 is disposed on the condensation section 110 of the tubular body 100. The heat section 220 is disposed on the evaporation section 120 of the tubular body 100. A wall thickness T3 of the cold section 210 of the capillary structure 200 is greater than a wall thickness T4 of the heat section 220 of the capillary structure 200. The cold section 210 is connected to the heat section 220 via the link section 230. The link section 230 has a wall thickness gradually decreases from the cold section 210 to the heat section 220. As shown in FIG. 2, one side of the link section 230 connected to the cold section 210 has a wall thickness T5, the other side of the link section 230 connected to the heat section 220 has a wall thickness T6, and the wall thickness T5 gradually decreases to the wall thickness T6.

In this embodiment, the wall thickness T3 of the cold section 210 is uniform in an axial direction AA of the tubular body 100, and the wall thickness T4 of part of the heat section 220 is uniform in the axial direction AA of the tubular body 100; however, the present disclosure is not limited thereto. In some other embodiments, the wall thickness of part of the cold section of the capillary structure is uniform in the axial direction of the tubular body, and the wall thickness of the heat section of the capillary structure is uniform in the axial direction of the tubular body; in still some other embodiments, the wall thickness of the cold section of the capillary structure is uniform in the axial direction of the tubular body, and the wall thickness of the heat section of the capillary structure is uniform in the axial direction of the tubular body; in still further some other embodiments, the wall thickness of part of the cold section of the capillary structure is uniform in the axial direction of the tubular body, and the wall thickness of part of the heat section of the capillary structure is uniform in the axial direction of the tubular body.

In this embodiment, the wall thickness T5 of the side of the link section 230 connected to the cold section 210 is equal to the wall thickness T3 of the cold section 210, and the wall thickness T6 of the other side of the link section 230 connected to the heat section 220 is equal to the wall thickness T4 of the heat section 220; however, the present disclosure is not limited thereto. In some other embodiments, the wall thickness of the side of the link section connected to the cold section may not be equal to the wall thickness of the cold section, and the wall thickness of the side of the link section connected to the heat section may not be equal to the wall thickness of the heat section.

In this embodiment, the capillary structure 200 is made of a single piece in form of, for example, micro groove structure, metal mesh structure, sintered powder structure or sintered ceramic structure.

In this embodiment, a ratio of the wall thickness T3 of the cold section 210 of the capillary structure 200 to the wall thickness T1 of the condensation section 110 of the tubular body 100 ranges, for example, from 5 to 6, and a ratio of the wall thickness T4 of the heat section 220 of the capillary structure 200 to the wall thickness T2 of the evaporation section 120 of the tubular body 100 ranges, for example, from 3 to 4. In one embodiment, the wall thickness T1 of the condensation section 110 of the tubular body 100 is approximately 0.25 millimeters, the wall thickness T2 of the evaporation section 120 of the tubular body 100 is approximately 0.25 millimeters, the wall thickness T3 of the cold section 210 of the capillary structure 200 is approximately 1.4 millimeters, and the wall thickness T4 of the heat section 220 of the capillary structure 200 is approximately 1.1 millimeters.

According to the heat pipe 10 discussed in the above embodiments, the cold section 210 has a thicker wall thickness than the heat section 220 of the capillary structure 200, such that, while the evaporation section 120 is placed higher than the condensation section 110, the condensation section 110 of the heat pipe 10 still has a sufficient capillary action force to work against gravity, and the evaporation section 120 of the heat pipe 10 still has a sufficient evaporation rate, thereby forming the cooling circulation. And, the capability of transmitting liquid of the cold section 210 to the other one is stronger than that of the heat section 220, and the capability of evaporating liquid of the heat section 220 to the sealed chamber S is stronger than that of the cold section 210. As such, the heat pipe 10 can offer a sufficient capillary action force and effective heat transfer to ensure its functionality.

The embodiments are chosen and described in order to best explain the principles of the present disclosure and its practical applications, to thereby enable others skilled in the art best utilize the present disclosure and various embodiments with various modifications as are suited to the particular use being contemplated. It is intended that the scope of the present disclosure is defined by the following claims and their equivalents.

What is claimed is:

1. A heat pipe, comprising:

a tubular body, having an inner surface, wherein the inner surface forms a sealed chamber; and a capillary structure, located in the sealed chamber and arranged on the inner surface;

wherein the tubular body comprises a condensation section and an evaporation section connected to each other, the capillary structure comprises a cold section and a heat section connected to each other, the cold section is disposed on the condensation section, the heat section is disposed on the evaporation section, and a wall thickness of the cold section is greater than a wall thickness of the heat section;

wherein a ratio of the wall thickness of the cold section of the capillary structure to a wall thickness of the condensation section of the tubular body ranges from 5 to 6, and a ratio of the wall thickness of the heat section of the capillary structure to a wall thickness of the evaporation section of the tubular body ranges from 3 to 4.

2. The heat pipe according to claim 1, wherein at least part of the cold section of the capillary structure has a wall thickness being uniform in an axial direction of the tubular body, and at least part of the heat section of the capillary structure has a wall thickness being uniform in the axial direction.

3. The heat pipe according to claim 1, wherein the condensation section of the tubular body is in a cylindrical shape, and the evaporation section of the tubular body is in a relatively flat shape compared to the condensation section.

4. The heat pipe according to claim 3, wherein the evaporation section of the tubular body has two thermal contact surfaces that are opposite to and parallel to each other.

5. The heat pipe according to claim 1, wherein the wall thickness of the condensation section of the tubular body is equal to the wall thickness of the evaporation section of the tubular body.

6. The heat pipe according to claim 1, wherein each of the condensation section and the evaporation section of the tubular body has a uniform wall thickness.

7. The heat pipe according to claim 1, wherein the tubular body further comprises a connection section, the connection section has a first end and a second end that are opposite to each other and are respectively connected to the condensation section and the evaporation section, the capillary structure further comprises a link section connected to and located between the cold section and the heat section, and a wall thickness of one side of the link section connected to the cold section gradually decreases to a wall thickness of another side of the link section connected to the heat section.

8. The heat pipe according to claim 7, wherein the wall thickness of the side of the link section connected to the cold section is equal to the wall thickness of the cold section, and the wall thickness of the another side of the link section connected to the heat section is equal to the wall thickness of the heat section.

9. The heat pipe according to claim 1, wherein the inner surface of the tubular body has no groove provided thereon.

10. The heat pipe according to claim 9, wherein the inner surface is a smooth surface.

11. The heat pipe according to claim 1, wherein the capillary structure is made of a single piece.

12. A heat pipe, comprising:

a tubular body, having an inner surface, wherein the inner surface forms a sealed chamber; and a capillary structure, located in the sealed chamber and arranged on the inner surface;

wherein the tubular body comprises a condensation section and an evaporation section connected to each other, the capillary structure comprises a cold section and a heat section connected to each other, the cold section is disposed on the condensation section, the heat section is disposed on the evaporation section, and a wall thickness of the cold section is greater than a wall thickness of the heat section;

wherein a wall thickness of each of the condensation section and the evaporation section of the tubular body is 0.25 millimeters, the wall thickness of the cold section of the capillary structure is 1.4 millimeters, and the wall thickness of the heat section of the capillary structure is 1.1 millimeters.

* * * * *